US011854465B2

(12) United States Patent
Yang et al.

(10) Patent No.: US 11,854,465 B2
(45) Date of Patent: Dec. 26, 2023

(54) DRIVING CIRCUIT OF DISPLAY DEVICE AND DISPLAY DEVICE

(71) Applicant: Shenzhen China Star Optoelectronics Semiconductor Display Technology Co., Ltd., Guangdong (CN)

(72) Inventors: Bo Yang, Guangdong (CN); Pengfei Liang, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 562 days.

(21) Appl. No.: 17/040,602

(22) PCT Filed: Jun. 3, 2020

(86) PCT No.: PCT/CN2020/094130

§ 371 (c)(1),
(2) Date: Sep. 23, 2020

(87) PCT Pub. No.: WO2021/227148

PCT Pub. Date: Nov. 18, 2021

(65) Prior Publication Data

US 2023/0104084 A1 Apr. 6, 2023

(30) Foreign Application Priority Data

May 13, 2020 (CN) ..... 202010402876.4

(51) Int. Cl.
*G09G 3/32* (2016.01)
*G09G 3/20* (2006.01)

(52) U.S. Cl.
CPC ..... *G09G 3/32* (2013.01); *G09G 3/2011* (2013.01); *G09G 3/2014* (2013.01);
(Continued)

(58) Field of Classification Search
CPC ..... G09G 3/32–3291; G09G 2300/0421–043; G09G 2300/0439;
(Continued)

(56) References Cited

U.S. PATENT DOCUMENTS

2002/0140659 A1 10/2002 Mikami et al.
2008/0309597 A1 12/2008 Nam et al.
(Continued)

FOREIGN PATENT DOCUMENTS

CN 101202022 6/2008
CN 101329851 12/2008
(Continued)

*Primary Examiner* — Nathan Danielsen

(57) ABSTRACT

The present disclosure provides a driving circuit of a display device and the display device. The driving circuit includes an input unit, a control unit coupled to the input unit, and a light emitting unit coupled to the control unit. The control unit is configured to drive the light emitting unit to emit light. the control unit comprises a pulse width modulation (PWM) control unit and a pulse amplitude modulation (PAM) control unit, the PWM control unit and the PAM control unit are mutually independent, the PWM control unit is configured to control a light emitting time of the light emitting unit, and the PAM control unit is configured to control a magnitude of a driving current in the light emitting unit.

18 Claims, 3 Drawing Sheets

(52) U.S. Cl.
CPC ..... *G09G 3/2081* (2013.01); *G09G 2300/0426* (2013.01); *G09G 2300/0852* (2013.01); *G09G 2310/08* (2013.01); *G09G 2320/0233* (2013.01); *G09G 2320/0242* (2013.01); *G09G 2320/064* (2013.01); *G09G 2360/141* (2013.01)

(58) Field of Classification Search
CPC ..... G09G 2300/0452; G09G 2300/0809; G09G 2300/0814; G09G 2300/0842–0852; G09G 2310/0243; G09G 2310/0259; G09G 2310/0262; G09G 2310/06; G09G 2310/066; G09G 2310/067; G09G 2310/08; G09G 2320/0233; G09G 2320/0242; G09G 2320/04; G09G 2320/0626–064; G09G 2360/141; G09G 3/2081
See application file for complete search history.

(56) References Cited

U.S. PATENT DOCUMENTS

| | | | | |
|---|---|---|---|---|
| 2009/0302776 | A1* | 12/2009 | Szczeszynski ..... | H05B 45/38 315/246 |
| 2011/0242082 | A1 | 10/2011 | Kojima | |
| 2018/0293929 | A1* | 10/2018 | Shigeta ..... | G09G 3/3233 |
| 2018/0301080 | A1 | 10/2018 | Shigeta et al. | |
| 2019/0371232 | A1* | 12/2019 | Kim ..... | H01L 25/0753 |
| 2021/0407408 | A1* | 12/2021 | Yang ..... | G09G 3/3233 |

FOREIGN PATENT DOCUMENTS

| | | |
|---|---|---|
| CN | 107993609 | 5/2018 |
| CN | 108735143 | 11/2018 |
| CN | 109979378 | 7/2019 |
| CN | 110111727 | 8/2019 |
| CN | 110782831 | 2/2020 |
| CN | 111009210 | 4/2020 |
| WO | WO 2019/235114 | 12/2019 |

* cited by examiner

DRIVING CIRCUIT OF DISPLAY DEVICE AND DISPLAY DEVICE

RELATED APPLICATIONS

This application is a National Phase of PCT Patent Application No. PCT/CN2020/094130 having International filing date of Jun. 3, 2020, which claims the benefit of priority of Chinese Patent Application No. 202010402876.4 filed on May 13, 2020. The contents of the above applications are all incorporated by reference as if fully set forth herein in their entirety.

FIELD AND BACKGROUND OF THE INVENTION

The present disclosure relates to the field of display technologies, and particularly relates to a driving circuit of a display device and the display device.

At present, micro light emitting diodes (micro-LEDs) are a new generation display technology with self-luminous display characteristics. Compared with conventional organic light emitting diode (OLED) technology, micro-LED display devices have advantages of higher brightness, better luminous efficiency, and lower power consumption. According to unique voltage and current characteristics of micro-LEDs, illumination of conventional micro-LEDs basically adopts a constant current driving mode.

A luminescence wave of micro-LEDs will shift under different current densities. That is, a conventional pulse amplitude modulation (PAM) driving circuit (which is an amplitude driving mode used to control a driving current of a micro-LED and controls brightness through a value of the current) will cause screen color shift. At present, another pulse width modulation (PWM) driving circuit (which controls the brightness of the micro-LED by controlling a light emitting time) is used to dim the micro-LED. The PWM driving circuit can solve the problem of color shift of the micro-LEDs, has high efficiency, and can be accurately controlled. However, the PWM driving circuit has following shortcomings: short charging time, high data transmission broadband requirements (required to use random access memory for data cache), and inability to support high resolution.

In summary, conventional driving circuits of display devices and the display devices adopt the micro-LED display technology. When the PWM driving circuit is used to solve the problem of color shift of micro-LEDs, there are technical problems such as short charging time, high data transmission broadband requirements, and inability to support high resolution.

Conventional driving circuits of display devices and the display devices adopt the micro-LED display technology. When the PWM driving circuit is used to solve the problem of color shift of micro-LEDs, there are technical problems such as short charging time, high data transmission broadband requirements, and inability to support high resolution.

SUMMARY OF THE INVENTION

Embodiments of the present disclosure provides a driving circuit of a display device and the display device, adopting the micro-LED display technology, which can eliminate color shift and overcome the shortcomings of conventional PWM driving modes, thereby solving the technical problems, such as short charging time, high data transmission broadband requirements, and inability to support high resolution, which are occurred when conventional driving circuits of display devices adopts the micro-LED display technology and the PWM driving circuit is used to solve the color shift problem of the micro-LEDs.

Embodiments of the present disclosure provides a driving circuit of a display device, including an input unit, a control unit coupled to the input unit, and a light emitting unit coupled to the control unit, the control unit is configured to drive the light emitting unit to emit light;

wherein the control unit includes a pulse width modulation (PWM) control unit and a pulse amplitude modulation (PAM) control unit, the PWM control unit and the PAM control unit are mutually independent, the PWM control unit is configured to control a light emitting time of the light emitting unit, and the PAM control unit is configured to control a magnitude of a driving current in the light emitting unit.

In the driving circuit of the display device provided by embodiments of the present disclosure, the input unit is configured to detect a light chromaticity information of the light emitting unit and transmit the light chromaticity information to the control unit.

In the driving circuit of the display device provided by embodiments of the present disclosure, the input unit includes a PWM circuit scan signal, a PWM circuit data signal, a PAM circuit scan signal, and a PAM circuit data signal; wherein the PWM circuit scan signal is connected to gate electrodes of thin film transistors in the PWM control unit for scanning the PWM control unit line-by-line; the PWM circuit data signal is connected to source electrodes of the thin film transistors in the PWM control unit for controlling the light emitting time of the light emitting unit; the PAM circuit scan signal is connected to gate electrodes of thin film transistors in the PAM control unit for scanning the PAM control unit line-by-line; and the PAM circuit data signal is connected to source electrodes of the thin film transistors in the PAM control unit for controlling a magnitude of the driving current in the light emitting unit.

In the driving circuit of the display device provided by embodiments of the present disclosure, the PWM control unit includes a frequency sweep control module, a PWM data control module, and a PWM time control module, a first end of the PWM time control module is coupled to the frequency sweep control module, a second end of the PWM time control module is coupled to the PWM data control module, and a third end of the PWM time control module is coupled to the light emitting unit.

In the driving circuit of the display device provided by embodiments of the present disclosure, the frequency sweep control module includes a first thin film transistor, a first capacitor, and a first resistor, a source electrode of the first thin film transistor is connected to a reference voltage, and a gate electrode of the first thin film transistor is connected to an input control terminal, and a drain electrode of the first thin film transistor is connected to the PWM time control module.

In the driving circuit of the display device provided by embodiments of the present disclosure, the PWM data control module includes a second thin film transistor, a source electrode of the second thin film transistor is connected to the PWM circuit data signal, a gate electrode of the second thin film transistor is connected to the PWM circuit scan signal, and a drain electrode of the second thin film transistor is connected to the PWM time control module.

In the driving circuit of the display device provided by embodiments of the present disclosure, the PWM time control module includes a second capacitor, a voltage comparator, and a third thin film transistor, a positive input terminal of the voltage comparator is connected to one end of the second capacitor and the PWM data control module, a negative input terminal of the comparator is connected to the frequency sweep control module, an output terminal of the voltage comparator is connected to a gate electrode of the third thin film transistor, a source electrode of the third thin film transistor is grounded, and a drain electrode of the third thin film transistor is connected to the light emitting unit.

In the driving circuit of the display device provided by embodiments of the present disclosure, the PWM time control module further includes a voltage follower, a positive input terminal of the voltage follower is connected to one end of the second capacitor and the PWM data control module, a negative input terminal of the voltage follower is connected to the positive input terminal of the voltage comparator, and an output terminal of the voltage follower is connected to the positive input terminal of the voltage comparator.

In the driving circuit of the display device provided by embodiments of the present disclosure, the PAM control unit includes a fourth thin film transistor, a source electrode of the fourth thin film transistor is connected to the PAM circuit data signal, a gate electrode of the fourth thin film transistor is connected to the PAM circuit scan signal, and a drain electrode of the fourth thin film transistor is connected to the light emitting unit.

In the driving circuit of the display device provided by embodiments of the present disclosure, the light emitting unit includes a third capacitor, a fifth thin film transistor, and a micro light emitting diode (micro-LED) light source, one end of the third capacitor is connected to the control unit, and the other end of the third capacitor is grounded; a gate electrode of the fifth thin film transistor is connected to the control unit and the third capacitor, a source electrode of the fifth thin film transistor is grounded, and a drain electrode of the fifth thin film transistor is connected to one end of the Micro-LED light source, and the other end of the micro-LED light source is connected to a positive input voltage of a power supply.

Embodiments of the present disclosure further provides a display device, the display device includes a driving circuit, the driving circuit includes an input unit, a control unit coupled to the input unit, and a light emitting unit coupled to the control unit, the control unit is configured to drive the light emitting unit to emit light;

wherein the control unit includes a pulse width modulation (PWM) control unit and a pulse amplitude modulation (PAM) control unit, the PWM control unit and the PAM control unit are mutually independent, the PWM control unit is configured to control a light emitting time of the light emitting unit, and the PAM control unit is configured to control a magnitude of a driving current in the light emitting unit.

In the display device provided by embodiments of the present disclosure, the input unit is configured to detect a light chromaticity information of the light emitting unit and transmit the light chromaticity information to the control unit.

In the display device provided by embodiments of the present disclosure, the input unit includes a PWM circuit scan signal, a PWM circuit data signal, a PWM circuit scan signal, and a PAM circuit data signal; wherein the PWM circuit scan signal is connected to gate electrodes of thin film transistors in the PWM control unit for scanning the PWM control unit line-by-line; the PWM circuit data signal is connected to source electrodes of the thin film transistors in the PWM control unit for controlling the light emitting time of the light emitting unit; the PAM circuit scan signal is connected to gate electrodes of thin film transistors in the PAM control unit for scanning the PAM control unit line-by-line; and the PAM circuit data signal is connected to source electrodes of the thin film transistors in the PAM control unit for controlling a magnitude of the driving current in the light emitting unit.

In the display device provided by embodiments of the present disclosure, the PWM control unit includes a frequency sweep control module, a PWM data control module, and a PWM time control module, a first end of the PWM time control module is coupled to the frequency sweep control module, a second end of the PWM time control module is coupled to the PWM data control module, and a third end of the PWM time control module is coupled to the light emitting unit.

In the display device provided by embodiments of the present disclosure, the frequency sweep control module includes a first thin film transistor, a first capacitor, and a first resistor, a source electrode of the first thin film transistor is connected to a reference voltage, and a gate electrode of the first thin film transistor is connected to an input control terminal, and a drain electrode of the first thin film transistor is connected to the PWM time control module.

In the display device provided by embodiments of the present disclosure, the PWM data control module includes a second thin film transistor, a source electrode of the second thin film transistor is connected to the PWM circuit data signal, a gate electrode of the second thin film transistor is connected to the PWM circuit scan signal, and a drain electrode of the second thin film transistor is connected to the PWM time control module.

In the display device provided by embodiments of the present disclosure, the PWM time control module includes a second capacitor, a voltage comparator, and a third thin film transistor, a positive input terminal of the voltage comparator is connected to one end of the second capacitor and the PWM data control module, a negative input terminal of the comparator is connected to the frequency sweep control module, an output terminal of the voltage comparator is connected to a gate electrode of the third thin film transistor, a source electrode of the third thin film transistor is grounded, and a drain electrode of the third thin film transistor is connected to the light emitting unit.

In the display device provided by embodiments of the present disclosure, the PWM time control module further includes a voltage follower, a positive input terminal of the voltage follower is connected to one end of the second capacitor and the PWM data control module, a negative input terminal of the voltage follower is connected to the positive input terminal of the voltage comparator, and an output terminal of the voltage follower is connected to the positive input terminal of the voltage comparator.

In the display device provided by embodiments of the present disclosure, the PAM control unit includes a fourth thin film transistor, a source electrode of the fourth thin film transistor is connected to the PAM circuit data signal, a gate electrode of the fourth thin film transistor is connected to the PAM circuit scan signal, and a drain electrode of the fourth thin film transistor is connected to the light emitting unit.

In the display device provided by embodiments of the present disclosure, the light emitting unit includes a third capacitor, a fifth thin film transistor, and a micro light emitting diode (micro-LED) light source, one end of the third capacitor is connected to the control unit, and the other end of the third capacitor is grounded; a gate electrode of the fifth thin film transistor is connected to the control unit and the third capacitor, a source electrode of the fifth thin film transistor is grounded, and a drain electrode of the fifth thin film transistor is connected to one end of the micro-LED light source, and the other end of the micro-LED light source is connected to a positive input voltage of a power supply.

Compared with prior art, the driving circuit of the display device and the display device provided in embodiments of the present disclosure adopt the micro-LED display technology and use mutually independent PWM control unit and PAM control unit to simultaneously control the light emitting unit to drive light, thereby overcoming uneven brightness caused by the threshold voltage of the TFT while solving the problem of color shift under PAM driving. Thus, the display device has a long charging time, a general data bandwidth requirement, and can support high resolution, which further improves display effect of the display device.

DESCRIPTION OF SPECIFIC EMBODIMENTS OF THE INVENTION

Embodiments of the present disclosure aim to solve technical problems, such as short charging time, high data transmission broadband requirements, and inability to support high resolution, which occur when conventional driving circuits of display devices adopt the PWM driving circuit to solve the color shift problem of the micro-LEDs. The embodiments can solve this defect.

Figure 1:
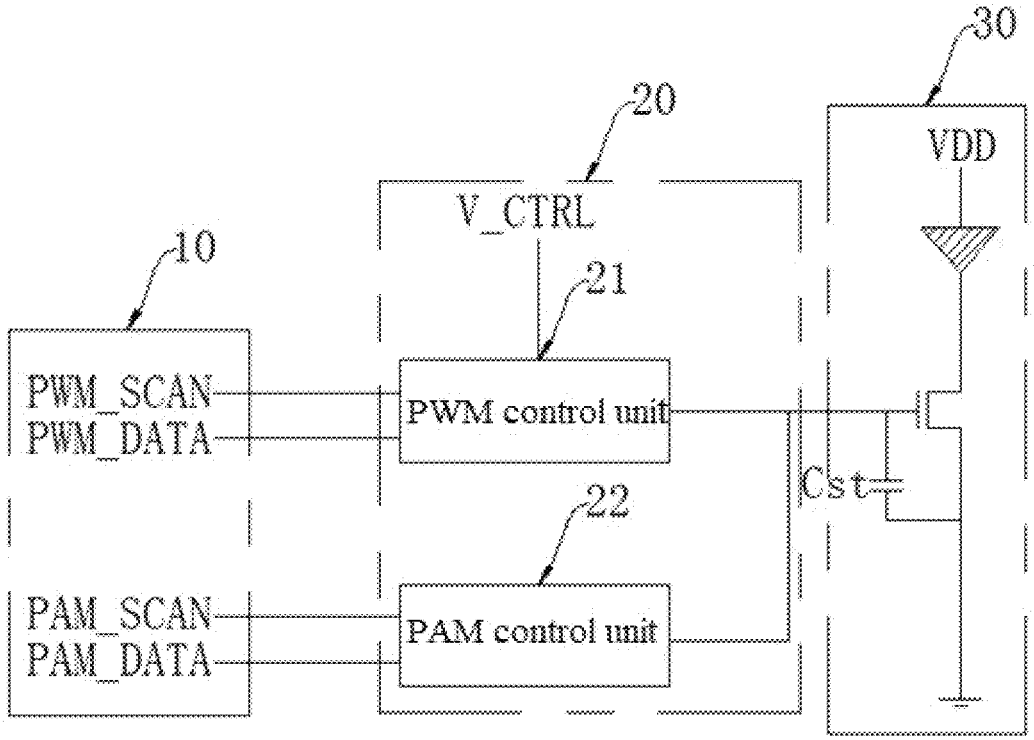
FIG. 1 is a schematic diagram of a driving circuit of a display device provided by an embodiment of the present disclosure.

As shown in FIG. 1, it is a schematic diagram of a driving circuit of a display device provided by the embodiment of the present disclosure. Wherein, the driving circuit of the display device includes an input unit 10, a control unit 20 coupled to the input unit 10, and a light emitting unit 30 coupled to the control unit 20. The control unit 20 is configured to drive the light emitting unit 30 to emit light. In a preferred embodiment, a light source of the light emitting unit 30 is micro-LEDs.

Specifically, the control unit 20 includes a pulse width modulation (PWM) control unit and a pulse amplitude modulation (PAM) control unit, and the PWM control unit and the PAM control unit are mutually independent. The PWM control unit is configured to control a light emitting time of the micro-LEDs in the light emitting unit 30, and the PAM control unit is configured to control a magnitude of a driving current in the light emitting unit 30.

Specifically, the input unit 10 is configured to detect a light chromaticity information of the micro-LEDs in the light emitting unit and transmit the light chromaticity information to the control unit 20. Wherein, the input unit includes a PWM circuit scan signal (PWM_SCAN), a PWM circuit data signal (PWM_DATA), a PAM circuit scan signal (PAM_SCAN), and a PAM circuit data signal (PAM_DATA).

Specifically, the PWM circuit scan signal (PWM_SCAN) is connected to gate electrodes of thin film transistors in the PWM control unit for scanning the PWM control unit line-by-line. The PWM circuit data signal (PWM_DATA) is connected to source electrodes of the thin film transistors in the PWM control unit for controlling the light emitting time of the light emitting unit 30. The PAM circuit scan signal (PAM_SCAN) is connected to gate electrodes of thin film transistors in the PAM control unit for scanning the PAM control unit line-by-line, and the PAM circuit data signal (PAM_DATA) is connected to source electrodes of the thin film transistors in the PAM control unit for controlling a magnitude of the driving current in the light emitting unit. Preferably, a voltage of the PAM circuit data signal (PAM_DATA) is a fixed reference voltage (VREF).

Figure 2:
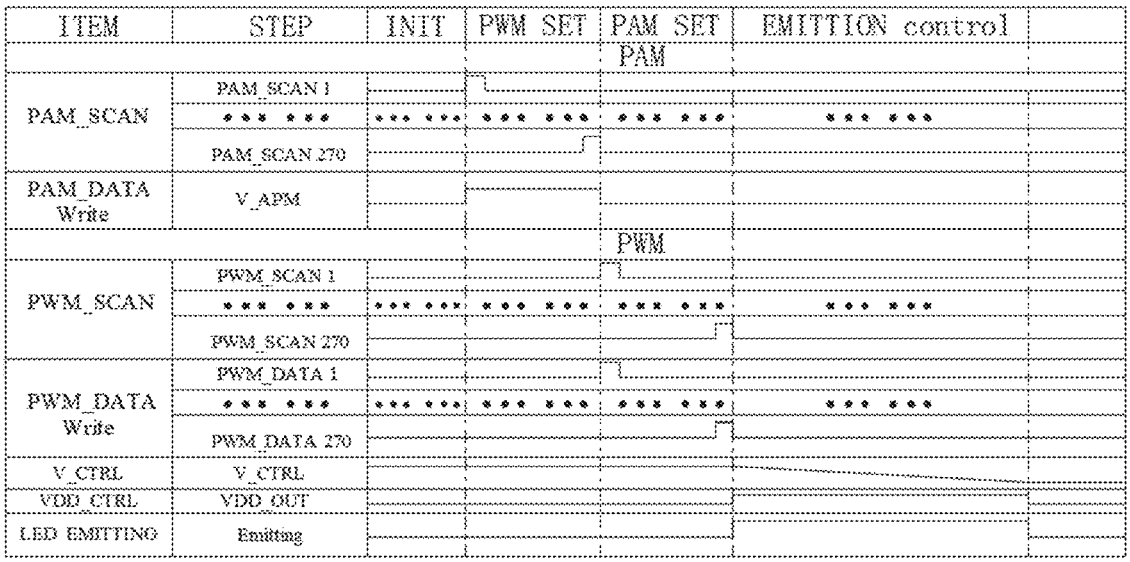
FIG. 2 is a timing diagram of various signals in the driving circuit of the display device provided by an embodiment of the present disclosure.

As shown in FIG. 2, it is a timing diagram (taking a refresh rate of 480*RGB*270*120 HZ as an example) of various signals in the driving circuit of the display device provided by an embodiment of the present disclosure. Specifically, FIG. 2 shows variations of the PWM circuit scan signal (PWM_SCAN), the PWM circuit data signal (PWM_DATA), the PAM circuit scan signal (PAM_SCAN), the PAM circuit data signal (PAM_DATA), an input control signal (V_CTRL), a voltage input control signal (VDD_CTRL), and a lighting signal of micro-LEDs (LED EMITTING) in the driving circuit of the display device according to time, and a specific process is as follows:

Firstly, the PAM circuit scan signal (PAM_SCAN) scans line-by-line and is written in the PAM circuit data signal (PAM_DATA). The PAM circuit data signal (PAM_DATA) may be supplied by a fixed reference voltage (VREF). Then, the PWM circuit scan signal (PWM_SCAN) scans line-by-line and is written in the PWM circuit data signal (PWM_DATA). A magnitude of the PWM circuit data signal (PWM_DATA) determines a light emitting time of the light emitting unit 30. Later, the PWM circuit data signal (PWM_DATA) is output to the PWM control unit, and the PWM control unit converts various PWM circuit data signals (PWM_DATA) into a light emitting control time of the light emitting unit 30. Lastly, charges in storage capacitors are discharged and a conversion of the input voltage to the light emitting time of the light emitting unit 30 is completed.

The driving circuit of the display device does not require a concept of subfields in the PWM drive circuit and has a longer charging time; secondly, the data bandwidth requirement is not high, and it has a driving method similar to that of ordinary displays; then, there is no need to consider a problem of drift and compensation of a threshold voltage Vth (when a voltage of the PAM circuit data signal PAM_DATA is appropriately large, the current is not sensitive to the threshold voltage) in the thin film transistor (TFT); lastly, because the display device emits light at a constant current, the problem of wavelength drift of the micro-LED light source in the light emitting unit 30 can be solved.

Figure 3A:
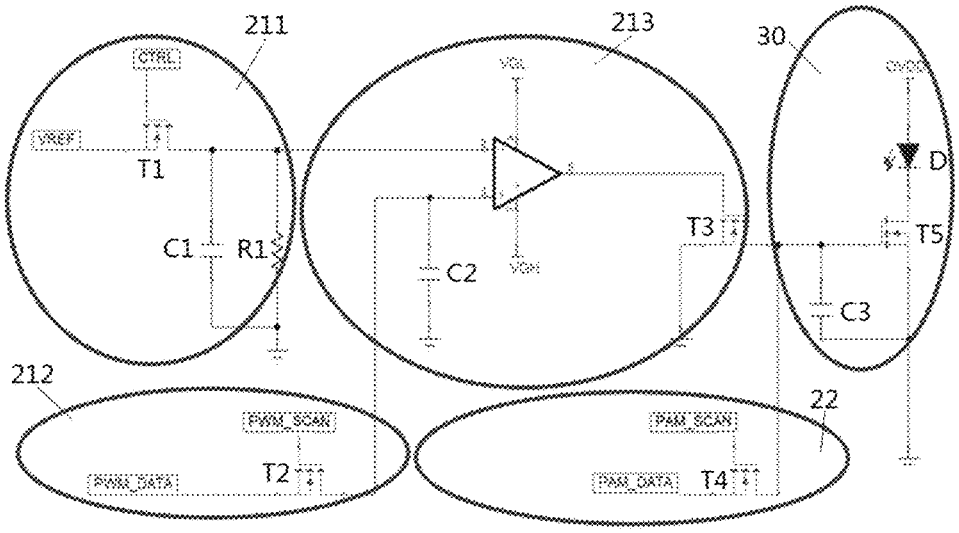
FIG. 3A is a driving circuit diagram of a display device provided by a first embodiment of the present disclosure.

As shown in FIG. 3A, it is a driving circuit diagram of a display device provided by a first embodiment of the present disclosure. Wherein, the PWM control unit 21 includes a frequency sweep control module 211, a PWM data control module 212, and a PWM time control module 213. A first end of the PWM time control module 213 is coupled to the frequency sweep control module 211, a second end of the PWM time control module 213 is coupled to the PWM data control module 212, and a third end of the PWM time control module 213 is coupled to the micro-LED light emitting unit 30.

Specifically, the frequency sweep control module 211 includes a first thin film transistor T1, a first capacitor C1, and a first resistor R1. A source electrode of the first thin film transistor T1 is connected to a reference voltage (VREF), and a gate electrode of the first thin film transistor T1 is connected to an input control terminal (V_CTRL), and a drain electrode of the first thin film transistor T1 is connected to the PWM time control module 213.

Specifically, the PWM data control module 212 includes a second thin film transistor T2. A source electrode of the second thin film transistor T2 is connected to the PWM circuit data signal (PWM_DATA), a gate electrode of the second thin film transistor T2 is connected to the PWM circuit scan signal (PWM_SCAN), and a drain electrode of the second thin film transistor T2 is connected to the PWM time control module 213.

Specifically, the PWM time control module 213 includes a second capacitor C2, a voltage comparator, and a third thin film transistor T3. A positive input terminal of the voltage comparator is connected to one end of the second capacitor C2 and the PWM data control module 212, a negative input terminal of the comparator is connected to the frequency sweep control module 211, an output terminal of the voltage comparator is connected to a gate electrode of the third thin film transistor T3. A source electrode of the third thin film transistor T3 is grounded, and a drain electrode of the third thin film transistor T3 is connected to the micro-LED light emitting unit 30.

Specifically, the PAM control unit 22 includes a fourth thin film transistor T4. A source electrode of the fourth thin film transistor T4 is connected to the PAM circuit data signal (PAM_DATA), a gate electrode of the fourth thin film transistor T4 is connected to the PAM circuit scan signal (PAM_SCAN), and a drain electrode of the fourth thin film transistor T4 is connected to the light emitting unit 30.

Specifically, the light emitting unit 30 includes a third capacitor C3, a fifth thin film transistor T5, and a micro light emitting diode (micro-LED) light source D. One end of the third capacitor C3 is connected to the control unit 20, and the other end of the third capacitor C3 is grounded. A gate electrode of the fifth thin film transistor T5 is connected to the control unit 20 and the third capacitor C3, a source electrode of the fifth thin film transistor T5 is grounded, and a drain electrode of the fifth thin film transistor T5 is connected to one end of the micro-LED light source D, and the other end of the micro-LED light source is connected to a positive input voltage of a power supply (VDD).

Figure 3B:
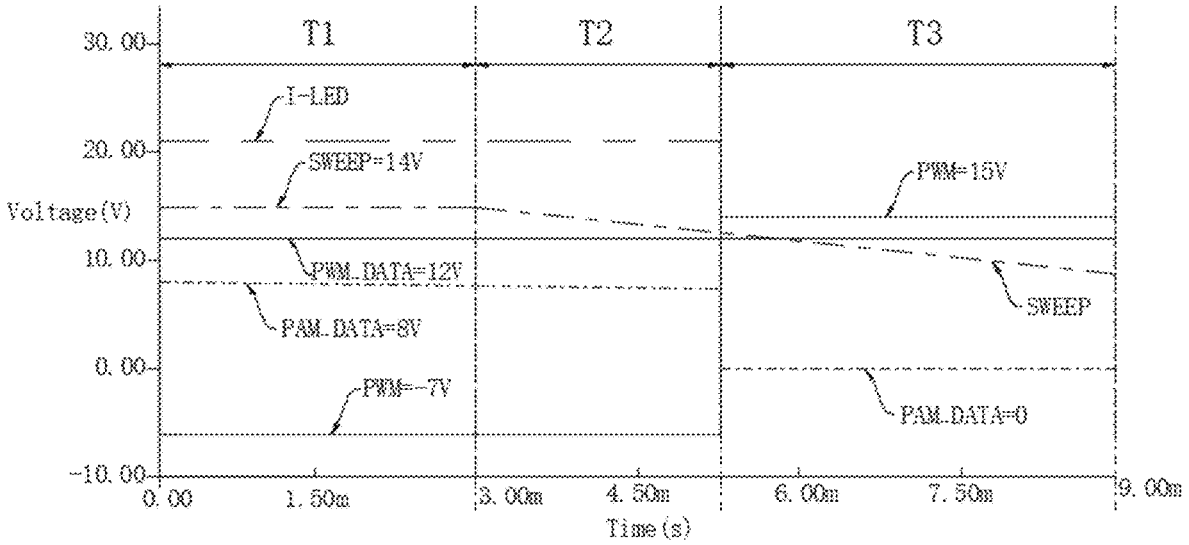
FIG. 3B is a timing diagram of various signals in the driving circuit of the display device provided by the first embodiment of the present disclosure.

As shown in FIG. 3B, it is a timing diagram (taking a refresh rate of 480*RGB*270*120 HZ as an example) of various signals in the driving circuit of the display device provided by the first embodiment of the present disclosure. Specifically, FIG. 3B shows variations of a frequency sweep voltage (SWEEP), the PWM circuit data signal (PWM_DATA), the PAM circuit scan signal (PAM_SCAN), the PAM circuit data signal (PAM_DATA), an output voltage of the PWM control unit (PWM), and a current (I-LED) of a light emitting signal of the micro-LEDs in the light emitting unit 30 in the driving circuit of the display device provided by the first embodiment of the present disclosure according to time, and a specific process is as follows:

During a first time period T1 (3 ms), the frequency sweep control module 211 charges, the sweep voltage (SWEEP) of the frequency sweep control module 211 is 14V, the PAM circuit scan signal (PAM_SCAN) scans line-by-line and is written in the PAM circuit data signal (PAM_DATA), and a voltage of the PAM circuit data signal (PAM_DATA) is 8V. Then, the PWM circuit scan signal (PWM_SCAN) scans line-by-line and is written in the PWM circuit data signal (PWM_DATA), and a voltage of the PWM circuit data signal (PWM_DATA) is 12V. Later, the PWM circuit data signal (PWM_DATA) is output to the PWM control unit, and the PWM control unit converts the various PWM circuit data signal (PWM_DATA) into the light emitting control time of the micro-LEDs, and finally inputs it to the light emitting unit 30 to make the micro-LED emit light. An output voltage of the PWM control unit (PWM) is −7V.

During a second time period T2 (3 ms), the sweep voltage (SWEEP) of the frequency sweep control module 211 drops and starts to discharge. When the sweep voltage (SWEEP) of the frequency sweep control module 211 is larger than an input voltage of the PWM circuit data signal (PWM_DATA), an AMP inputs a low level, the output terminal of the voltage comparator in the PWM time control module 213 outputs the sweep voltage to the light emitting unit 30. At this time, the PWM data control module 212 is turned off, and the PAM circuit data signal (PAM_DATA) controls and drives the thin film transistor T5 to flow current, and the light emitting unit 30 emits light.

During a third time period T3 (3 ms), the sweep voltage (SWEEP) of the frequency sweep control module 211 continues to discharge. When the sweep voltage (SWEEP) of the frequency sweep control module 211 is less than the input voltage of the PWM circuit data signal (PWM_DATA), the AMP inputs a high level, and the output terminal of the voltage comparator in the PWM time control module 213 outputs the input voltage of the PWM circuit data signal (PWM_DATA) to the light emitting unit 30. At this time, the PWM data control module 212 is turned on and releases the voltage of the PAM circuit data signal (PAM_DATA) to control the drive to turn off the thin film transistor T5, and the light emitting unit 30 is turned off.

The driving circuit of the display device provided in the first embodiment of the present disclosure uses a voltage comparator to realize function of converting the magnitude of the voltage into the length of the light emitting time.

Figure 4:
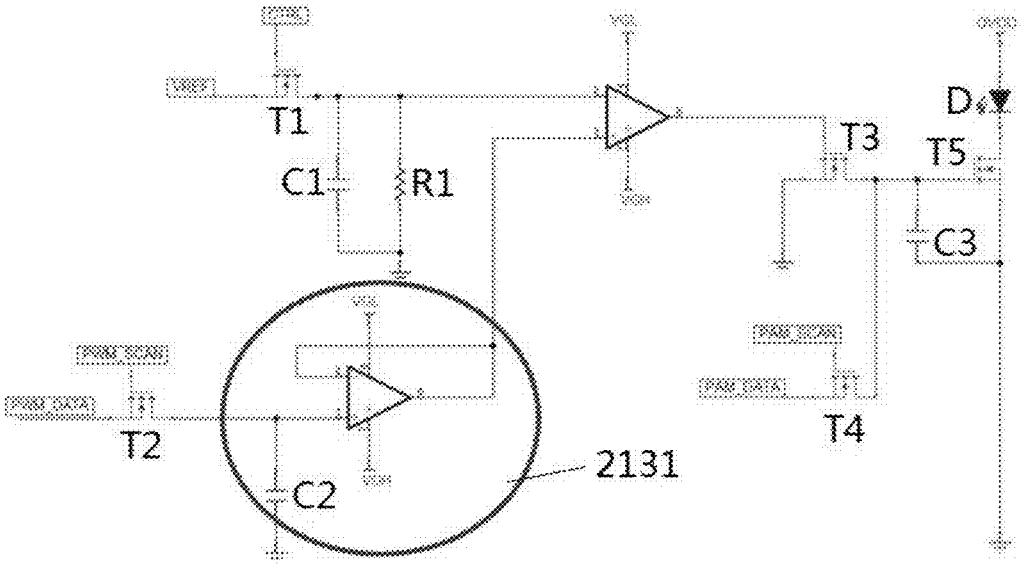
FIG. 4 is a driving circuit diagram of a display device provided by a second embodiment of the present disclosure.

As shown in FIG. 4, it is a driving circuit diagram of a display device provided by a second embodiment of the present disclosure. Wherein, the only difference between the second embodiment of the present disclosure and the first embodiment of the present disclosure is that: the PWM time control module 213 further includes a voltage follower module 2131. The voltage follower module 2131 includes a voltage follower, a positive input terminal of the voltage follower is connected to one end of the second capacitor C2 and the PWM data control module 212, a negative input terminal of the voltage follower is connected to the positive input terminal of the voltage comparator, and an output terminal of the voltage follower is connected to the positive input terminal of the voltage comparator.

The driving circuit of the display device provided by the second embodiment of the present disclosure uses the voltage follower to overcome a coupling phenomenon of the PWM circuit data signal (PWM_DATA) caused by dropping of the sweep voltage (SWEEP), thereby overcoming the uneven brightness caused by the threshold voltage of the TFT and improving a charging rate.

Figure 5:
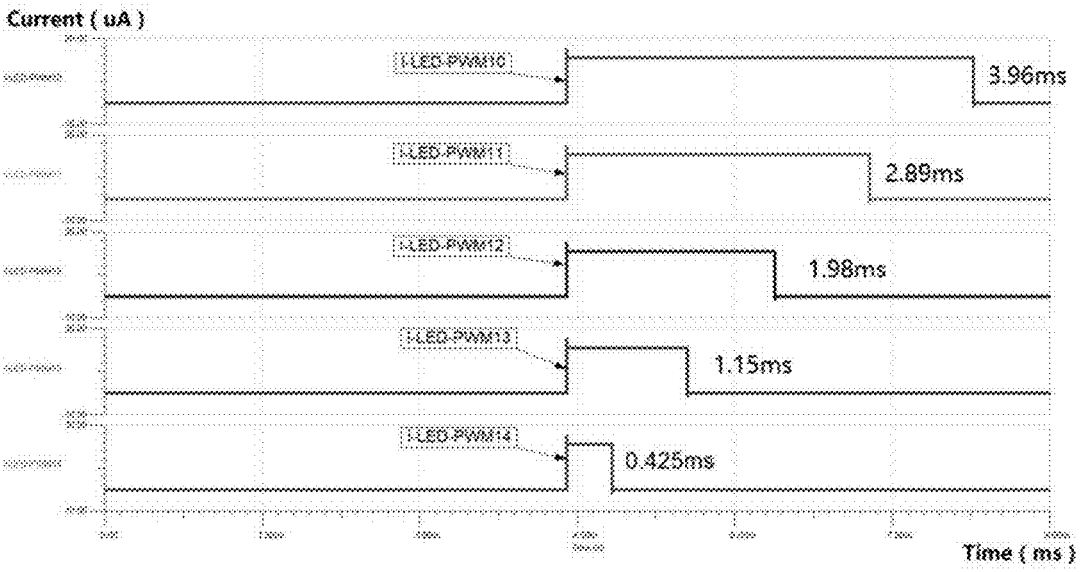
FIG. 5 is a schematic comparison diagram of light emitting times of micro-LED under different PWM_DATA voltages in the driving circuit of the display device provided by an embodiment of the present disclosure.

As shown in FIG. 5, it is a schematic comparison diagram of light emitting times of the micro-LED under different PWM_DATA voltages in the driving circuit of the display device provided by an embodiment of the present disclosure. Experimental results in FIG. 5 show that, under different input voltages of the PWM circuit data signal (PWM_DATA), the light emitting unit 30 can achieve different light emitting time. That is, it can be divided into grayscales with different levels.

The present disclosure further provides a display device having the driving circuit.

For the specific implementation of the above operations, reference may be made to the previous embodiments, which will not be repeated herein.

In summary, the driving circuit of the display device and the display device provided in embodiments of the present disclosure use mutually independent PWM control unit and PAM control unit to simultaneously control the light emitting unit to drive light, thereby overcoming the uneven brightness caused by the threshold voltage of the TFT while solving the problem of color shift under PAM driving. Thus, the display device has a long charging time, a general data bandwidth requirement, and can support high resolution, which further improves display effect of the display device.

It can be understood that for those of ordinary skill in the art, equivalent substitutions or changes can be made according to the technical solutions of the present disclosure and its inventive concept, and all these changes or substitutions shall fall within a protection scope of the appended claims of the present disclosure.

What is claimed is:

1. A driving circuit of a display device, comprising:

an input unit;

a control unit coupled to the input unit; and a light emitting unit coupled to the control unit, and the control unit configured to drive the light emitting unit to emit light;

wherein the control unit comprises a pulse width modulation (PWM) control unit and a pulse amplitude modulation (PAM) control unit, the PWM control unit and the PAM control unit are mutually independent, the PWM control unit is configured to control a light emitting time of the light emitting unit, and the PAM control unit is configured to control a magnitude of a driving current in the light emitting unit; and wherein the PWM control unit comprises a frequency sweep control module, a PWM data control module, and a PWM time control module, a first end of the PWM time control module is coupled to the frequency sweep control module, a second end of the PWM time control module is coupled to the PWM data control module, and a third end of the PWM time control module is coupled to the light emitting unit.

2. The driving circuit of the display device in claim 1, wherein the input unit is configured to detect a light chromaticity information of the light emitting unit and transmit the light chromaticity information to the control unit.

3. The driving circuit of the display device in claim 2, wherein the input unit comprises a PWM circuit scan signal, a PWM circuit data signal, a PAM circuit scan signal, and a PAM circuit data signal;

wherein the PWM circuit scan signal is connected to gate electrodes of thin film transistors in the PWM data control module for scanning the PWM control unit line-by-line, the PWM circuit data signal is connected to source electrodes of the thin film transistors in the PWM data control module for controlling the light emitting time of the light emitting unit, the PAM circuit scan signal is connected to gate electrodes of thin film transistors in the PAM control unit for scanning the PAM control unit line-by-line, and the PAM circuit data signal is connected to source electrodes of the thin film transistors in the PAM control unit for controlling a magnitude of the driving current in the light emitting unit.

4. The driving circuit of the display device in claim 3, wherein the frequency sweep control module comprises a first thin film transistor, a first capacitor, and a first resistor, a source electrode of the first thin film transistor is connected to a reference voltage, a gate electrode of the first thin film transistor is connected to an input control terminal, and a drain electrode of the first thin film transistor is connected to the PWM time control module.

5. The driving circuit of the display device in claim 3, wherein the PWM data control module comprises a second thin film transistor, a source electrode of the second thin film transistor is connected to the PWM circuit data signal, a gate electrode of the second thin film transistor is connected to the PWM circuit scan signal, and a drain electrode of the second thin film transistor is connected to the PWM time control module.

6. The driving circuit of the display device in claim 3, wherein the PWM time control module comprises a second capacitor, a voltage comparator, and a third thin film transistor, a positive input terminal of the voltage comparator is connected to one end of the second capacitor and the PWM data control module, a negative input terminal of the comparator is connected to the frequency sweep control module, an output terminal of the voltage comparator is connected to a gate electrode of the third thin film transistor, a source electrode of the third thin film transistor is grounded, and a drain electrode of the third thin film transistor is connected to the light emitting unit.

7. The driving circuit of the display device in claim 6, wherein the PWM time control module further comprises a voltage follower, a positive input terminal of the voltage follower is connected to one end of the second capacitor and the PWM data control module, a negative input terminal of the voltage follower is connected to the positive input terminal of the voltage comparator, and an output terminal of the voltage follower is connected to the positive input terminal of the voltage comparator.

8. The driving circuit of the display device in claim 3, wherein the PAM control unit comprises a fourth thin film transistor, a source electrode of the fourth thin film transistor is connected to the PAM circuit data signal, a gate electrode of the fourth thin film transistor is connected to the PAM circuit scan signal, and a drain electrode of the fourth thin film transistor is connected to the light emitting unit.

9. The driving circuit of the display device in claim 1, wherein the light emitting unit comprises a third capacitor, a fifth thin film transistor, and a micro light emitting diode (micro-LED) light source, one end of the third capacitor is connected to the control unit, and the other end of the third capacitor is grounded; a gate electrode of the fifth thin film transistor is connected to the control unit and the third capacitor, a source electrode of the fifth thin film transistor is grounded, and a drain electrode of the fifth thin film transistor is connected to one end of the micro-LED light source, and the other end of the micro-LED light source is connected to a positive input voltage of a power supply.

10. A display device, comprising a driving circuit, the driving circuit comprising:

an input unit;

a control unit coupled to the input unit; and a light emitting unit coupled to the control unit, and the control unit configured to drive the light emitting unit to emit light;

wherein the control unit comprises a PWM control unit and a PAM control unit, the PWM control unit and the PAM control unit are mutually independent, the PWM control unit is configured to control a light emitting time of the light emitting unit, and the PAM control unit is configured to control a magnitude of a driving current in the light emitting unit; and wherein the PWM control unit comprises a frequency sweep control module, a PWM data control module, and a PWM time control module, a first end of the PWM time control module is coupled to the frequency sweep control module, a second end of the PWM time control module is coupled to the PWM data control module, and a third end of the PWM time control module is coupled to the light emitting unit.

11. The display device in claim 10, wherein the input unit is configured to detect a light chromaticity information of the light emitting unit and transmit the light chromaticity information to the control unit.

12. The display device in claim 11, wherein the input unit comprises a PWM circuit scan signal, a PWM circuit data signal, a PAM circuit scan signal, and a PAM circuit data signal;

wherein the PWM circuit scan signal is connected to gate electrodes of thin film transistors in the PWM data control module for scanning the PWM control unit line-by-line, the PWM circuit data signal is connected to source electrodes of the thin film transistors in the PWM data control module for controlling the light emitting time of the light emitting unit, the PAM circuit scan signal is connected to gate electrodes of thin film transistors in the PAM control unit for scanning the PAM control unit line-by-line, and the PAM circuit data signal is connected to source electrodes of the thin film transistors in the PAM control unit for controlling a magnitude of the driving current in the light emitting unit.

13. The display device in claim 12, wherein the frequency sweep control module comprises a first thin film transistor, a first capacitor, and a first resistor, a source electrode of the first thin film transistor is connected to a reference voltage, and a gate electrode of the first thin film transistor is connected to an input control terminal, and a drain electrode of the first thin film transistor is connected to the PWM time control module.

14. The display device in claim 12, wherein the PWM data control module comprises a second thin film transistor, a source electrode of the second thin film transistor is connected to the PWM circuit data signal, a gate electrode of the second thin film transistor is connected to the PWM circuit scan signal, and a drain electrode of the second thin film transistor is connected to the PWM time control module.

15. The display device in claim 12, wherein the PWM time control module comprises a second capacitor, a voltage comparator, and a third thin film transistor, a positive input terminal of the voltage comparator is connected to one end of the second capacitor and the PWM data control module, a negative input terminal of the comparator is connected to the frequency sweep control module, an output terminal of the voltage comparator is connected to a gate electrode of the third thin film transistor, a source electrode of the third thin film transistor is grounded, and a drain electrode of the third thin film transistor is connected to the light emitting unit.

16. The display device in claim 15, wherein the PWM time control module further comprises a voltage follower, a positive input terminal of the voltage follower is connected to one end of the second capacitor and the PWM data control module, a negative input terminal of the voltage follower is connected to the positive input terminal of the voltage comparator, and an output terminal of the voltage follower is connected to the positive input terminal of the voltage comparator.

17. The display device in claim 12, wherein the PAM control unit comprises a fourth thin film transistor, a source electrode of the fourth thin film transistor is connected to the PAM circuit data signal, a gate electrode of the fourth thin film transistor is connected to the PAM circuit scan signal, and a drain electrode of the fourth thin film transistor is connected to the light emitting unit.

18. The display device in claim 10, wherein the light emitting unit comprises a third capacitor, a fifth thin film transistor, and a micro light emitting diode (micro-LED) light source, one end of the third capacitor is connected to the control unit, and the other end of the third capacitor is grounded; a gate electrode of the fifth thin film transistor is connected to the control unit and the third capacitor, a source electrode of the fifth thin film transistor is grounded, a drain electrode of the fifth thin film transistor is connected to one end of the micro-LED light source, and the other end of the micro-LED light source is connected to a positive input voltage of a power supply.

* * * * *